US005813098A

United States Patent [19]

Schneider

[11] Patent Number: 5,813,098

[45] Date of Patent: Sep. 29, 1998

[54] MEMORIAL CANDLESTICK

[76] Inventor: Anthony J. Schneider, Box 32, Pense, Saskatchewan, Canada, S0G 3W0

[21] Appl. No.: 726,985

[22] Filed: Oct. 7, 1996

[51] Int. Cl.[6] ..... A61G 17/08

[52] U.S. Cl. ..... 27/1; 431/297

[58] Field of Search ..... 27/1, 2, 35; D26/9, D26/10; 431/289, 295, 297

[56] References Cited

U.S. PATENT DOCUMENTS

| | | | |
|---|---|---|---|
| D. 80,472 | 2/1930 | Allen | D26/9 |
| D. 213,450 | 3/1969 | Black . | |
| D. 279,129 | 6/1985 | Wendt | D26/9 |
| 2,235,617 | 3/1941 | Klinzing . | |
| 2,513,951 | 7/1950 | McClellen . | |
| 2,562,726 | 7/1951 | MacDonald et al. . | |
| 2,835,014 | 9/1958 | Dioguardi, Jr. . | |
| 3,045,855 | 7/1962 | Lipman | 431/297 |
| 3,167,844 | 2/1965 | Bachofner . | |
| 3,654,675 | 4/1972 | Peterson . | |
| 3,932,113 | 1/1976 | Thrush | 431/297 |
| 4,328,942 | 5/1982 | Birnbaum | 248/558 |
| 5,029,373 | 7/1991 | Raymond . | |
| 5,379,499 | 1/1995 | Jackson . | |
| 5,613,760 | 3/1997 | Dunn | 362/161 |

*Primary Examiner*—Kien T. Nguyen
*Attorney, Agent, or Firm*—Adrian D. Battison; Murray E. Thrift

[57] ABSTRACT

A storage and memorial device for cremation ashes comprises a candlestick which is modified relative to a conventional candlestick by the addition of a receptacle and closure plug for that receptacle at a base of the vertical bore of the candlestick. The receptacle is used to contain cremation ashes as a memorial for the departed loved one with the memorial effect being enhanced by the spiritual effect of burning the candle.

6 Claims, 4 Drawing Sheets

MEMORIAL CANDLESTICK

BACKGROUND OF THE INVENTION

This invention relates to a memorial candlestick which can be used for storing cremation ashes whereby ashes from the cremation of a loved one can be stored in the candlestick to enhance the memorial effect.

Cremation after death is becoming more widely accepted. Up till now, however, the techniques for storage of the ashes have been generally unsatisfactory in that they are often stored simply in an urn which by itself is not entirely suitable for display since it is readily apparent that it is an urn. Many persons have therefore chosen to bury the urn to provide a memorial based upon a plot of land. Yet others choose to spread the ashes in a particularly preferred place.

SUMMARY OF THE INVENTION

It is one object of the present invention, therefore, to provide an improved candlestick which has a receptacle to provide an enhanced memorial effect.

Candlesticks are of course well known for supporting candles either as an attractive ornament or as a support for burning candles as an attractive illumination source.

However the candlestick of the present invention is modified to incorporate a receptacle for storing the cremation ashes. Receptacles for storing cremation ashes are also of course well known but the present invention is more than merely an aggregation of such components since the mounting of the receptacle for the cremation ashes within the candlestick itself provides an enhanced memorial effect when burning the candle mounted in the candlestick. In this way the cremation ashes of the departed loved one can be stored in a suitable attractive container. But in addition the burning of the candle which is often used in itself as a spiritual experience enhances the memorial effect since the spiritual experience of the burning of the candle is associated with the memorial of the storage of the cremation ashes. The candle can therefore be burned at suitable occasions for example as an anniversary memorial providing the combination or synergistic effect of the memorial of the cremation ashes with the spiritual effect of the burning of the candle.

One embodiment of the invention will now be described in conjunction with the accompanying drawings in which:

DETAILED DESCRIPTION

Figure 1:
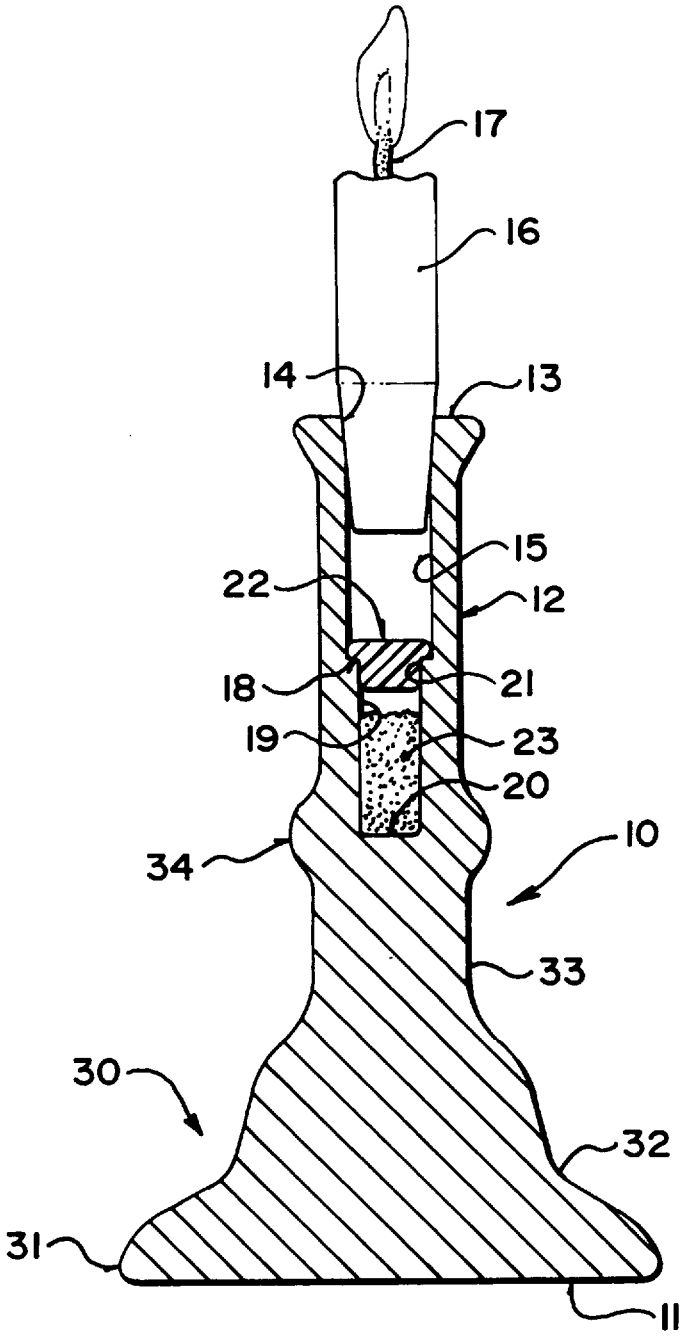
FIG. 1 is a cross sectional view through a storage and memorial device according to the present invention.

The device of the present invention comprises a candlestick generally indicated at 10 with a base portion having a horizontal bottom surface 11 for resting upon a suitable support surface with the candlestick defining a support portion 12 standing vertically upwardly from the horizontal base surface 11. The base portion generally indicated at 30 includes a base band 31 standing upwardly from the bottom surface 11. Above the base band, the base portion converges upwardly and inwardly as indicated at 32 to form a generally frusto conical portion. The frusto conical portion converges inwardly to a neck portion 33 which is cylindrical. The neck portion is thus narrower in diameter or width than the base band. Above the neck portion is provided a raised rib 34 which separates the neck portion 33 from the generally cylindrical support portion 12. The support portion 12 also has a width or diameter less than that of the band portion 31. Thus the candlestick converges generally inwardly with a wider base. The candlestick is generally closed in its interior and when turned from wood is generally solid apart from the openings described hereinafter.

The support member includes an upper surface 13 with a circular opening 14 connecting with a hollow bore 15 within the support member. The vertical bore 15 receives a candle 16 standing vertically upwardly for burning of a wick 17 in conventional manner. At the base of the bore 15 which is normally a blind bore having a flat base 18, there is provided a counter bore 19 of slightly smaller diameter than the bore 15 and extending downwardly therefrom to a position further into the support member towards the base surface 11. The counter bore 19 defines a receptacle with a base 20 and a circular opening 21 in the base 18 of the bore 15. The circular opening 21 is closed by a plug 22 which is engaged into the receptacle and thus forms a further base surface for the bottom of the vertical bore 15. The receptacle 19 with the plug 22 thus forms a container for cremation ashes 23.

The cylindrical bore is shaped so that it closely surrounds the bottom portion of the candle so as to hold the candle vertical. There is therefore little or no space surrounding the candle inside the cylindrical bore so that the candle is supported substantially along the full length of that portion of the candle which is retained within the bore. The outside surface of the support portion at the bore is also generally cylindrical so as to closely surround the outside of the bore leaving a relatively thin wall of the support portion surrounding the bore.

It will be appreciated that the dimension of the receptacle 19 is not sufficient to receive the full quantity of cremation ashes which are normally supplied from a cremation. However the small receptacle 19 can be used to store some of the cremation ashes and thus act as a memorial for those cremation ashes. In addition when the candle is burned, the spiritual effect of the burning of the candle combines with the memorial effect of the receptacle to provide an enhanced memorial for the departed loved one.

On the undersurface of the base is provided a plaque in the form of a circular brass plate 25 with an engraved inscription 26 identifying the deceased person. The brass plate lies flat on the base surface so that the base sits on a suitable support surface with the plaque downwards. Alternatively, the plaque can be of other shapes and positioned at any other suitable location on the candlestick.

Figure 2:
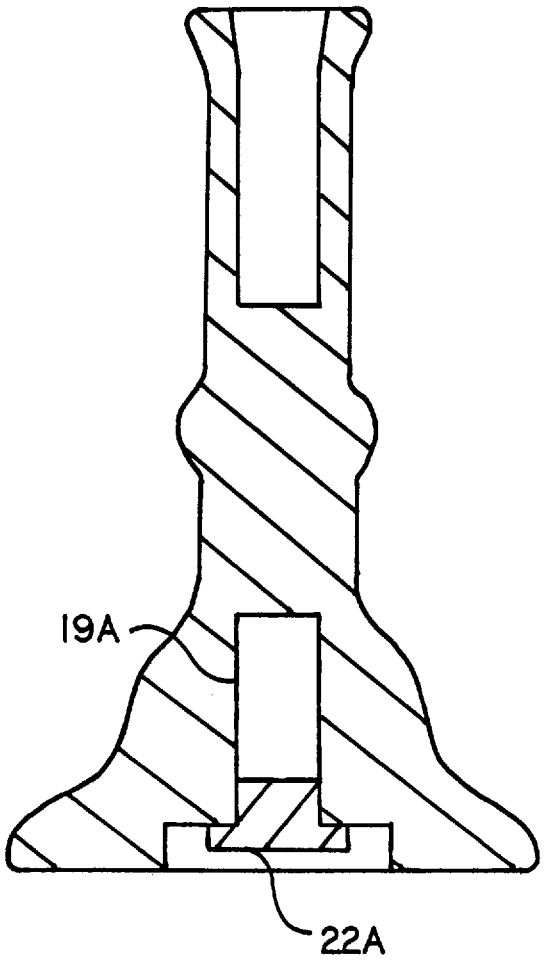
FIG. 2 is a similar cross-section to that of FIG. 1 showing a modified arrangement.

In FIG. 2 is shown a modified arrangement in which the receptacle 19A is located in the base surface with a plug 22A recessed into the base surface to allow the base surface to properly sit on the support.

Figure 2A:
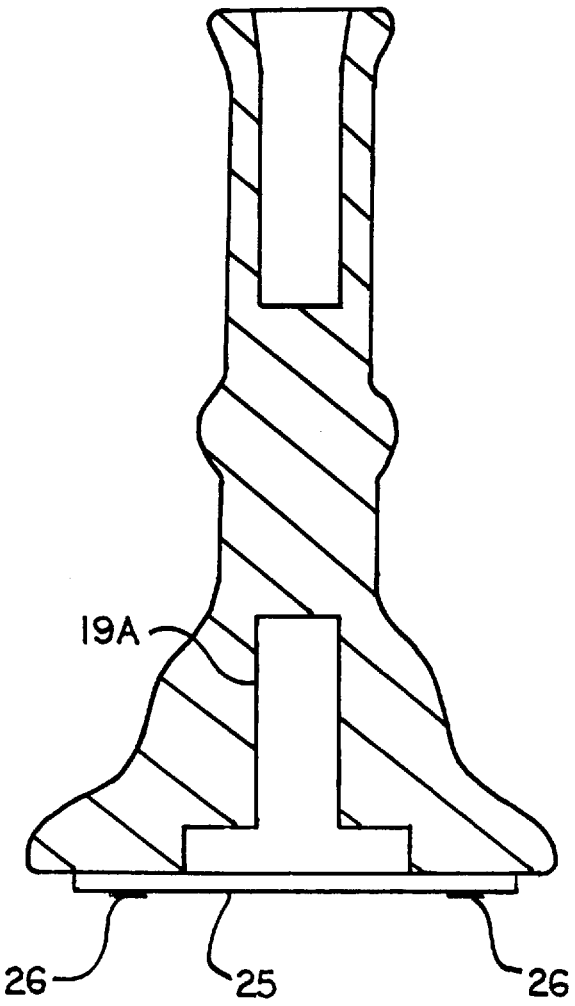
FIG. 2A is a similar cross section to that of FIG. 1 showing a further modified arrangement.

In a further alternative arrangement shown in FIG. 2A, the plug 22A is omitted and instead the receptacle 19A is covered by a flat base plaque similar to the plaque 25. In a situation where the ashes are to be hidden, the base plaque can be of brass or similar opaque material. If the purchaser wishes to be able to view the ashes, the plaque can be formed of a transparent material such as Plexiglas.

Figure 3:
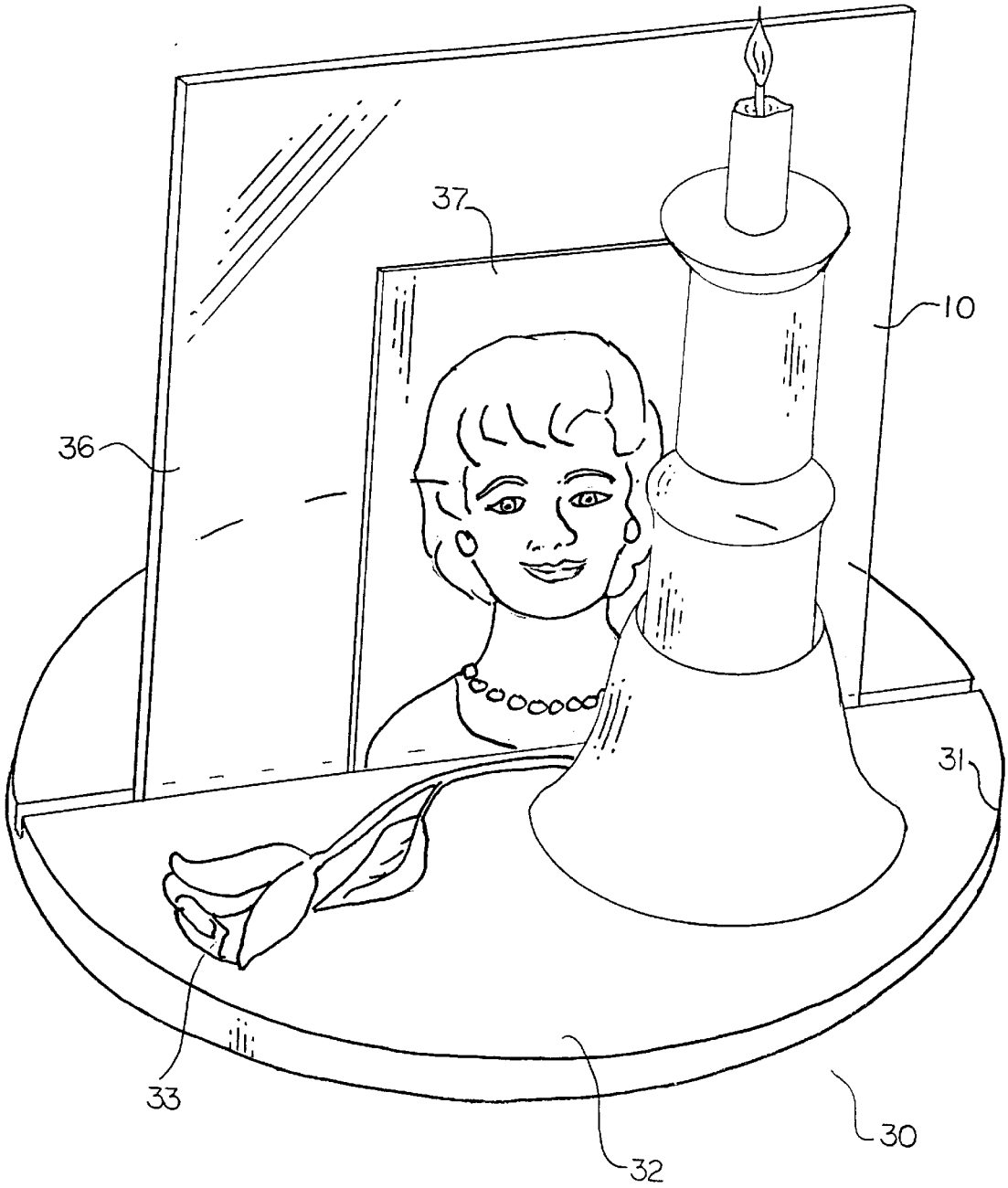
FIG. 3 is a side elevational view of the device of FIG. 1 in conjunction with a display stand.

In FIG. 3, the candlestick of FIGS. 1 and 2 generally indicated at 10 is used in conjunction with a stand 30 for further enhancing the effectiveness of the memorial. In particular the stand comprises a horizontal wooden plinthe 31 in the form of a generally flat plate of wood or similar material having a horizontal upper surface 32 and an undersurface for resting upon a support such as a table. On the horizontal upper surface is provided the candlestick 10 and a flower or other ornament 33 which is simply laid across the wooden plinthe in an attractive manner. The wooden plinthe has a slot 34 of rectangular cross section extending across the plinthe at a position rearwardly of a mid line of the plinthe leaving sufficient space forwardly of the slot to receive the candlestick and the flower. The plinthe can be of any required shape but in the example shown is oval in plan view. A rectangular sheet of transparent material 36 defines a display surface and stands on the plinthe with a lower edge of the rectangular sheet received within the slot 34. The thickness of the sheet is slightly less than that of the slot so that the sheet does not stand vertically upwardly but is instead inclined slightly rearwardly wedged in place within the slot by its rear inclination. A rear inclination of the order of 15° allows the sheet and the display front surface of a sheet to receive a photograph 37 resting on the sheet with its bottom edge trapped within the slot and standing upwardly from the slot in front of the display surface. The photograph is preferably a further memorial of the deceased for example a portrait photograph.

In FIGS. 4, 5, and 6 are shown other examples of cross sectional shape of the candle stick including the base portion generally indicated at 100 and the support portion generally indicated at 200. In this case the support portion has an outer surface which has a slight concave curvature so that it converges inwardly and downwardly and then diverges outwardly and downwardly to a wider bottom portion 201. From the wider bottom portion the support portion converges inwardly as indicated at 202 to a first neck 203 above a rib 204. The neck 205 of the base portion in this case is of similar diameter to the neck 203 and narrower than the main body of the support portion. The candlestick is formed mainly from turned wood but includes a brass ring 206 attached around the opening 207 in the top surface of the support portion. In FIGS. 5 and 6, the base portion is shaped as indicated at 208 and 209 to provide a more fancy shape.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A candlestick comprising:

a base portion having a horizontal bottom surface for resting on a support surface;

a support portion carried by the base portion and standing upwardly therefrom;

the base portion being shaped so as to converge upwardly and inwardly from a base band at the bottom surface to define a neck section narrower in width than the base band above the base band;

the support portion being located above the neck section and having a width less than that of the base band;

the support portion defining a horizontal upper surface and a vertical generally cylindrical bore of substantially constant diameter within the support portion extending to an opening in the upper surface;

a candle projecting into the vertical bore and located by engagement with the vertical bore so as to stand vertically upwardly from the upper surface;

a receptacle in the candlestick defined by a counterbore at a base of the vertical bore which is smaller in diameter than the vertical bore with a filler opening and a plug member for closing the filler opening underneath the candle.

2. The device according to claim 1 wherein there is provided a plaque on the candlestick having engraved information thereon.

3. The device according to claim 2 wherein the plaque is on the undersurface of the base.

4. A candlestick and support stand comprising:

a candle stick having:

a base portion having a horizontal bottom surface for resting on a support surface;

a support portion carried by the base portion and standing upwardly therefrom;

the base portion being shaped so as to converse upwardly and inwardly from a base band at the bottom surface to define a neck section narrower in width than the base band above the base band;

the support portion being located above the neck section and having a width less than that of the base band;

the support portion defining a horizontal upper surface and a vertical generally cylindrical bore of substantially constant diameter within the support portion extending to an opening in the upper surface;

a candle projecting into the vertical bore and located by engagement with the vertical bore so as to stand vertically upwardly from the upper surface;

a receptacle in the candlestick with a filler opening at a surface of the candlestick and a plug member for closing the filler opening;

and a support stand for the candlestick having a base and a generally upstanding display surface rearwardly of the candlestick;

the base comprising a generally horizontal surface on which is located a slot with the display surface defined by a transparent sheet mounted in the slot so as to lean rearwardly from the candlestick.

5. A candlestick comprising:

a base portion having a horizontal bottom surface for resting on a support surface;

a support portion carried by the base portion and standing upwardly therefrom;

the base portion being shaped so as to converge upwardly and inwardly from a base band at the bottom surface to define a neck section narrower in width than the base band above the base band;

the support portion being located above the neck section and having a width less than that of the base band;

the support portion defining a horizontal upper surface and a vertical generally cylindrical bore of substantially constant diameter within the support portion extending to an opening in the upper surface;

a candle projecting into the vertical bore and located by engagement with the vertical bore so as to stand vertically upwardly from the upper surface;

a receptacle in the candlestick defined by a bore extending upwardly into the base portion with a filler opening at a bottom of the bore exposed for filling from the bottom surface and a plug member closing the filler opening, the plug member having a width greater than a width of the bore within the base portion.

6. A candlestick comprising:

a base portion having a horizontal bottom surface for resting on a support surface;

a support portion carried by the base portion and standing upwardly therefrom;

the base portion being shaped so as to converge upwardly and inwardly from a base band at the bottom surface to define a neck section narrower in width than the base band above the base band;

the support portion being located above the neck section and having a width less than that of the base band;

the support portion defining a horizontal upper surface and a vertical generally cylindrical bore of substantially constant diameter within the support portion extending to an opening in the upper surface;

a candle projecting into the vertical bore and located by engagement with the vertical bore so as to stand vertically upwardly from the upper surface;

a receptacle in the candlestick defined by a bore extending upwardly into the base portion with a filler opening at a bottom of the bore exposed for filling from the bottom surface and a plaque plate attached to the bottom surface and covering the filler opening, the plaque plate having a width greater than a width of the bore within the base portion.

* * * * *